US006618970B1

(12) United States Patent
Fillman et al.

(10) Patent No.: US 6,618,970 B1
(45) Date of Patent: Sep. 16, 2003

(54) NONSKID LABEL

(75) Inventors: Gina L. Fillman, Omaha, NE (US); David J. Voss, Omaha, NE (US)

(73) Assignee: Industrial Label Corporation, Omaha, NE (US)

( * ) Notice: Subject to any disclaimer, the term of this patent is extended or adjusted under 35 U.S.C. 154(b) by 0 days.

(21) Appl. No.: 10/247,694

(22) Filed: Sep. 19, 2002

(51) Int. Cl.[7] ..... G09F 3/00
(52) U.S. Cl. ..... 40/312; 40/637; 40/638
(58) Field of Search ..... 40/324, 637, 638, 40/306, 312; 283/81

(56) References Cited

U.S. PATENT DOCUMENTS 496,131 A * 4/1893 Peirce ..... 40/324
4,801,077 A * 1/1989 Sweatt et al. ..... 229/113
5,205,452 A * 4/1993 Mankey ..... 224/275
5,645,300 A * 7/1997 Hill ..... 40/638
5,657,916 A * 8/1997 Tackett ..... 224/404
5,704,649 A * 1/1998 Small ..... 40/638
5,989,328 A * 11/1999 Stahovic et al. ..... 106/36

* cited by examiner

*Primary Examiner*—Gary Hoge
(74) *Attorney, Agent, or Firm*—Thomte, Mazour & Niebergall; Dennis L. Thomte

(57) ABSTRACT

A label for use on the bottom of a first food container which is adapted to engage a second food container positioned below the first food container to prevent movement of the first food container relative to the second food container. The bottom surface of the label has a nonskid material such as varnish applied thereto.

26 Claims, 3 Drawing Sheets

NONSKID LABEL

BACKGROUND OF THE INVENTION

1. Field of the Invention

This invention relates to a nonskid label and more particularly to a nonskid label which is applied to the bottom of a food package or container to prevent movement of the food package with respect to another food package positioned immediately therebelow.

2. Description of the Related Art

It is a common practice of meat departments of stores to package meat such as ground beef or the like in a container or tray and then cover the same with a plastic film. Frequently, the packages are then placed in a large display tray and are usually arranged on the display tray so that the packages are stacked one upon the other in at least two layers. The display tray is then carried to the refrigerated meat display case and placed therein in an inclined manner so that the meat packages are conveniently visible and accessible to the customers. If a customer should remove one of the meat packages from the lower end of the upper layer of packages, the packages positioned behind (above) the removed package sometimes slip downwardly (forwardly) with respect to the lower layer of packages which sometimes results in the packages in the uppermost layer sliding from the display tray into the display case or onto the floor.

SUMMARY OF THE INVENTION

A nonskid label is described for use on the bottom of a food package or container with the label having upper and lower surfaces. The upper surface of the label is secured to the bottom surface of the package. The lower surface of the label has a skid-resistant or nonskid material thereon which adapted to engage a food package positioned therebelow. The nonskid material on the lower surface of the label frictionally engages the food package positioned therebelow to prevent relative movement of the food package relative to the food package immediately therebelow.

It is a principal object of the invention to provide a novel label for use on the bottom surface of a food package or container with the label having a nonskid material applied to its bottom surface.

A further object of the invention is to provide a label of the type described which prevents relative movement of food containers or packages which are positioned one above the other in layers.

A further object of the invention is to provide a label of the type described above which is easily applied to a food container or package.

These and other objects will be obvious to those skilled in the art.

DESCRIPTION OF THE PREFERRED EMBODIMENT

Figure 1:
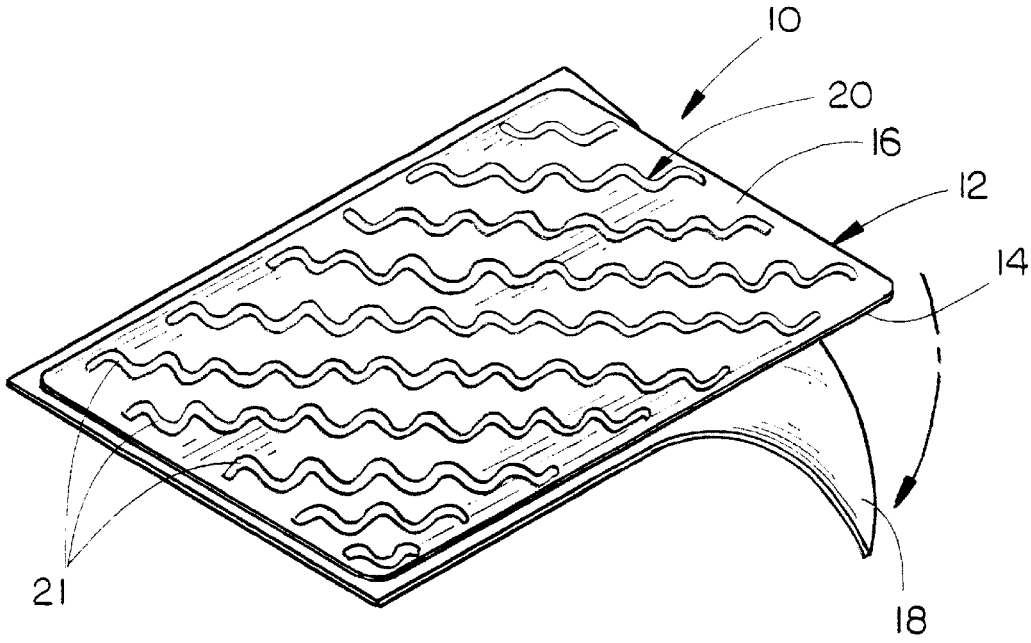
FIG. 1 is a bottom perspective view of the label of this invention.
Figure 2:
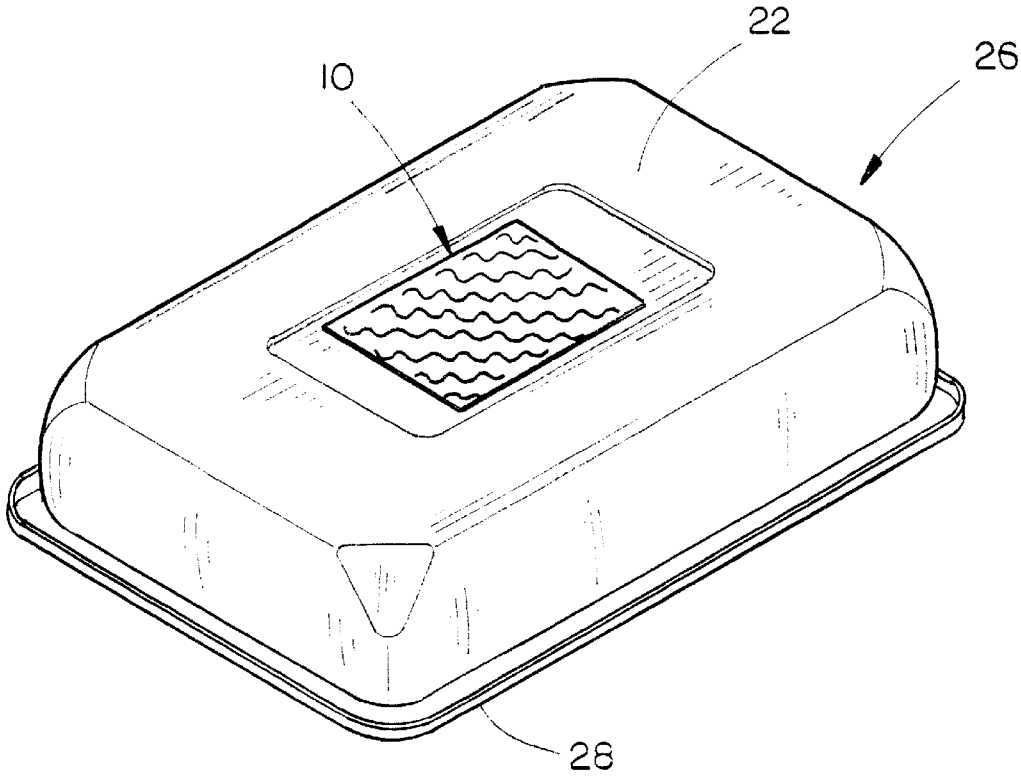
FIG. 2 is a bottom perspective view of a food container or package having the label of this invention mounted thereon.
Figure 3:
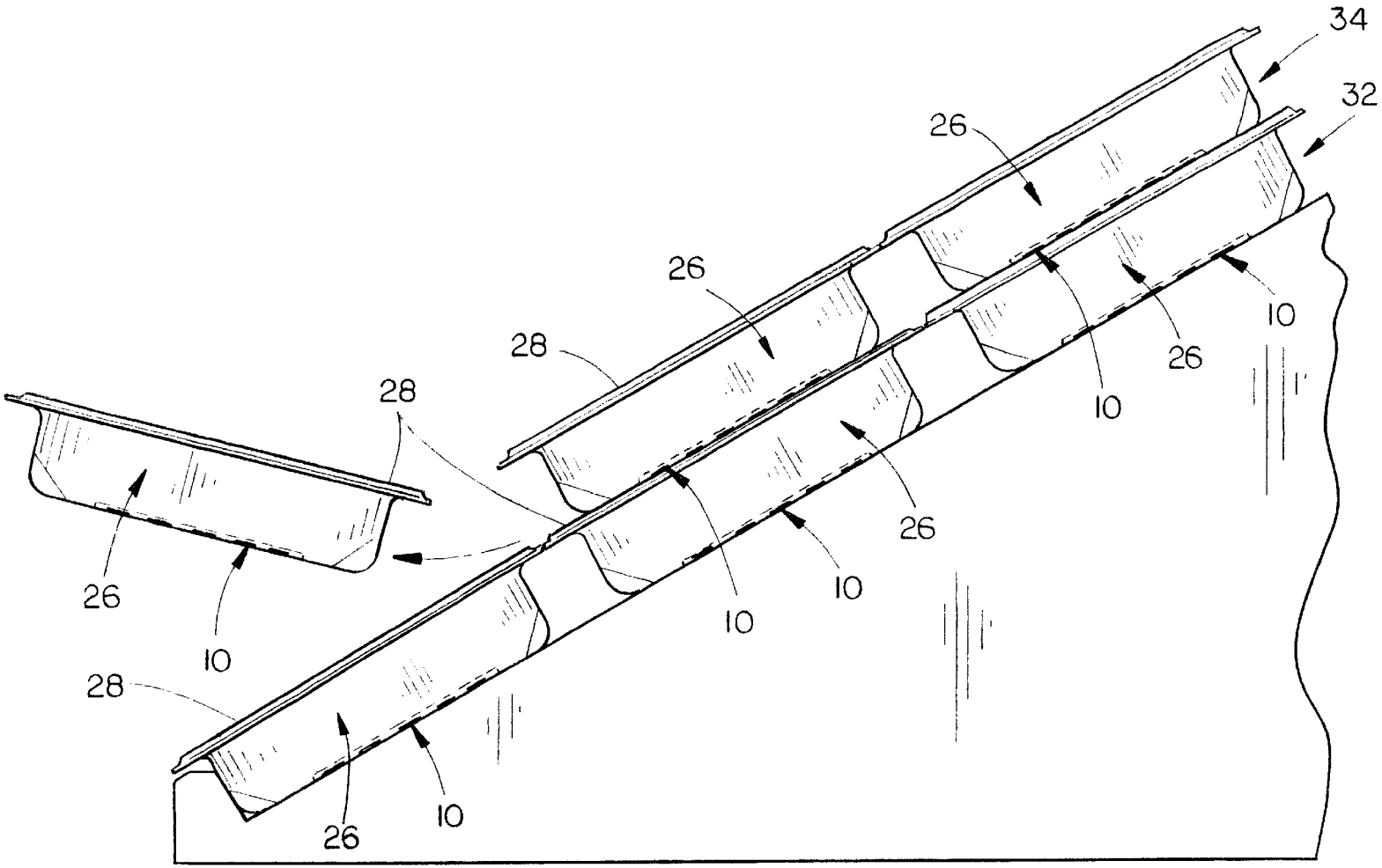
FIG. 3 is a side view illustrating the manner in which a plurality of food containers or packages are arranged in a food display case.

The numeral 10 refers to the label of this invention including a conventional, flexible substrate 12 having an upper surface 14 and a bottom surface 16. The label substrate may be comprised of any conventional substrate material commonly used in the label industry. Usually, the bottom surface 16 of substrate 12 will be provided with printing such as safe handling instructions, cooking tips, recipes, etc. The bottom surface 16 may be devoid of such printing if desired. If printing is placed on the bottom surface 16 of substrate 12, it is recommended, but not necessary, that the print be covered with a suitable material such as solvent or UV varnish to prevent the ink of the print from running or smearing. The upper surface 14 of substrate 12 is preferably provided with a pressure-sensitive adhesive material thereon or a conventional glue. If a pressure-sensitive material is utilized on substrate 12, the same is initially covered with a film 18 until such time as the label is to be applied to the food container.

The bottom surface 16 of substrate 12 is provided with a nonskid material 20 such as RAD-KOTE MP03 which is a UV screen/flexo coating manufactured by RAD-CURE Corporation, 9 Audrey Place, Fairfield, N.J. 07004. RAD-KOTE MP03 is a UV curable, screen/flexo soft touch coating for applications requiring a nonskid surface. The product is cured to a smooth, soft, "grabby" gloss coating with a clean and bright appearance. The coating has good adhesion to most plastic and papers, as well as relatively low shrinkable, good flexibility and resistance to cracking. The typical properties of RAD-KOTE MP03 are:

| | |
|---|---|
| Brookfield Viscosity | 1500 cps @ 77° F. |
| Density | 9.0 lbs/gal |
| Odor | Typical Acrylate |
| Appearance | Hazy Viscous Liquid |
| Solids content | 100% |
| Cure Speed | 90 FT/MIN with 1× 300 watt/in lamps |
| Coverage | 4,000 $FT^2$/GAL @ 0.4 mil thickness |
| CureEnergy Absorbance | 135 $mj/cm^2$ |

Coatings such as RAD-KOTE MP03 are commonly referred to as flexible varnishes in the label industry. Although RAD-KOTE MP03 is the preferred nonskid material for this invention, other nonskid materials common to the industry may be utilized.

Preferably, the material 20 is applied to the bottom surface 16 of substrate 12 in an irregular pattern so that an interrupted pattern is created. As seen, the material 20 is applied in spaced-apart bands 21 having a zigzag pattern shaped so as to have a series of alternating turns from side to side. Although patterns other than zigzag may be used, it is important that the material 20 define interruptions to create the necessary "grabbing" characteristic to the material. The material 20 when dry is transparent or translucent. Material 20 may also be tinted if desired.

The completed label 10 is applied to the bottom surface 22 of bottom 24 of food container or package 26 which is normally formed from a polystyrene material. The label 10 may be applied to the bottom surface 22 before or after the food is placed in the container. A plastic film 28 is positioned over the food in the container to package the same. The containers or packages 26 are normally placed on a display tray 30 in at least first and second layers 32 and 34, respectively. The tray 30 is normally placed in a refrigerated display case in an inclined manner so that the packages are visible and conveniently accessible.

When one package is stacked upon another, the material 20 on the bottom surface 16 of the label 10 on the upper package will grip, grab or frictionally engage the film 28 on the package therebelow to prevent relative sliding movement of the upper package with respect to the package therebelow. Should a package 26 be removed from the upper layer 34, the packages behind (above) the removed package will not slide downwardly (forwardly) since the labels 10 on the packages are frictionally gripping the packages therebeneath.

Figure 4:
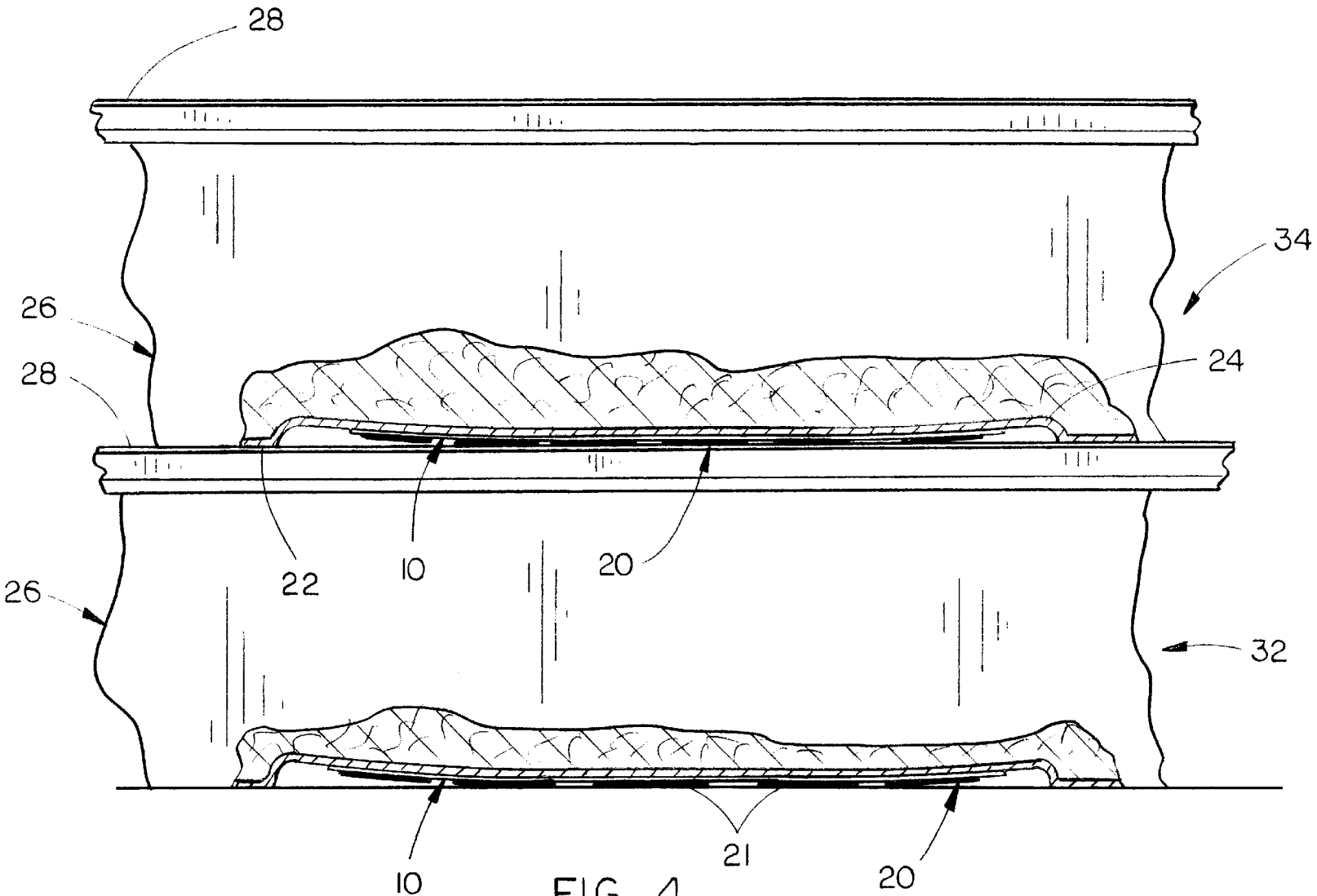
FIG. 4 is a side view of a pair of food containers stacked one upon the other with portions thereof cut away to more fully illustrate the invention.

If the label 10 is placed on the bottom surface of a container having a recessed portion formed therein, the label 10 will still engage the film on the package therebelow since the weight of the food in the package will tend to "bow" the bottom thereof downwardly towards the package therebelow, as seen in FIG. 4.

Thus, it can be seen that the invention accomplishes at least all of its stated objectives.

We claim:

1. In combination:

a first food container including a bottom having top and bottom surfaces;

a label having upper and lower surfaces;

said upper surface of said label being secured to said bottom surface of said first food container;

said lower surface of said label having a nonskid material thereon which is adapted to engage a second food container positioned below said first food container.

2. The combination of claim 1 wherein said label is flexible.

3. The combination of claim 1 wherein said nonskid material comprises a varnish material.

4. The combination of claim 1 wherein said nonskid material is placed on said bottom surface of said label in an irregular pattern.

5. The combination of claim 4 wherein said nonskid material comprises a plurality of spaced-apart bands of material.

6. The combination of claim 5 wherein said bands of material are irregularly shaped.

7. The combination of claim 5 wherein said bands of material define a zigzag pattern.

8. The combination of claim 5 wherein said bands of material are shaped so as to have a series of alternating turns from side to side.

9. The combination of claim 1 wherein said bottom surface of said label has food handling instructions printed thereon.

10. The combination of claim 1 wherein said nonskid material is placed on said bottom surface of said substrate in an irregular pattern.

11. The combination of claim 10 wherein said nonskid material comprises a plurality of spaced-apart bands of material.

12. The combination of claim 10 wherein said bands of material are irregularly shaped.

13. The combination of claim 10 wherein said bands of material define a zigzag pattern.

14. The combination of claim 10 wherein said bands of material are shaped so as to have a series of alternating turns from side to side.

15. A label for use on the bottom surface of a container, comprising:

a flexible substrate having upper and lower surfaces;

an adhesive on said upper surface of said substrate for securing said substrate to the bottom surface of a container;

said lower surface of said substrate having a nonskid material thereon.

16. The label of claim 15 wherein said nonskid material on said lower surface of said substrate is adapted to engage another container positioned therebelow.

17. The combination of claim 15 wherein said substrate is flexible.

18. The combination of claim 15 wherein said nonskid material comprises a varnish material.

19. The combination of claim 15 wherein said bottom surface of said substrate has food handling instructions printed thereon.

20. The combination of claim 19 wherein said nonskid material is transparent or translucent.

21. In combination with a first container including a bottom having a bottom surface, comprising:

a flexible substrate having upper and lower surfaces;

said upper surface of said substrate being secured to the bottom surface of the first container;

said lower surface of said substrate having a nonskid material thereon;

said nonskid material being placed on said lower surface of said substrate in an irregular pattern.

22. In combination with a first container including a bottom having a bottom surface, comprising:

a flexible substrate having upper and lower surfaces;

said upper surface of said substrate being secured to the bottom surface of the first container;

said lower surface of said substrate having a nonskid material thereon;

said substrate having food handling instructions printed thereon.

23. In combination with a first container including a bottom having a bottom surface, comprising:

a flexible substrate having upper and lower surfaces;

said upper surface of said substrate being secured to the bottom surface of the first container;

said lower surface of said substrate having a nonskid material thereon;

said substrate comprising a label.

24. In combination with a first container including a bottom having a bottom surface, comprising:

a flexible substrate having upper and lower surfaces;

said upper surface of said substrate being secured to the bottom surface of the first container;

said lower surface of said substrate having a nonskid material thereon;

said nonskid material being placed on said lower surface of said substrate in an irregular pattern;

said nonskid material comprising a plurality of spaced-apart bands of material; said bands of material being irregularly shaped.

25. In combination with a first container including a bottom having a bottom surface, comprising:

a flexible substrate having upper and lower surfaces;

said upper surface of said substrate being secured to the bottom surface of the first container;

said lower surface of said substrate having a nonskid material thereon;

said nonskid material being placed on said lower surface of said substrate in an irregular pattern;

said nonskid material comprising a plurality of spaced-apart bands of material; said bands of material defining a zigzag pattern.

26. In combination with a first container including a bottom having a bottom surface, comprising:

a flexible substrate having upper and lower surfaces;

said upper surface of said substrate being secured to the bottom surface of the first container;

said lower surface of said substrate having a nonskid material thereon;

said nonskid material being placed on said lower surface of said substrate in an irregular pattern;

said nonskid material comprising a plurality of spaced-apart bands of material; said bands of material being shaped so as to have a series of alternating turns from side to side.

* * * * *